US005587029A

United States Patent [19]

Sircar

[11] Patent Number: 5,587,029

[45] Date of Patent: Dec. 24, 1996

[54] MACHINEABLE ALUMINUM ALLOYS CONTAINING IN AND SN AND PROCESS FOR PRODUCING THE SAME

[75] Inventor: Subhasish Sircar, Richmond, Va.

[73] Assignee: Reynolds Metals Company, Richmond, Va.

[21] Appl. No.: 330,514

[22] Filed: Oct. 27, 1994

[51] Int. Cl.[6] ..... C22C 21/12

[52] U.S. Cl. ..... 148/438; 420/530

[58] Field of Search ..... 148/438; 420/530

[56] References Cited

U.S. PATENT DOCUMENTS

| | | | |
|---|---|---|---|
| 1,959,029 | 5/1934 | Kempf et al. . | |
| 2,026,547 | 1/1936 | Kempf et al. . | |
| 3,616,420 | 10/1971 | Broughton | 204/197 |
| 3,617,395 | 11/1971 | Ford . | |
| 4,005,243 | 1/1977 | Baba et al. | 428/469 |
| 4,082,573 | 4/1978 | Schoerner et al. . | |
| 4,196,262 | 4/1980 | Pryor et al. | 428/654 |
| 4,412,972 | 11/1983 | Mori | 420/530 |
| 4,452,866 | 6/1984 | Kamiya et al. | 428/653 |
| 4,631,172 | 12/1986 | Yamamoto et al. | 420/541 |
| 4,632,885 | 12/1986 | Tanabe et al. | 428/654 |
| 4,634,656 | 1/1987 | Ohashi et al. | 430/278 |
| 4,751,086 | 6/1988 | Jeffrey et al. | 429/218 |
| 4,885,045 | 12/1989 | May | 148/440 |
| 5,122,208 | 6/1992 | Alabi | 148/440 |
| 5,162,100 | 11/1992 | Tanaka et al. | 420/530 |
| 5,282,909 | 2/1994 | Ara et al. | 148/439 |
| 5,328,078 | 7/1994 | Okumura | 228/179.1 |

FOREIGN PATENT DOCUMENTS

| | | | |
|---|---|---|---|
| 52-20312 | 2/1977 | Japan | 420/530 |
| 61-159547 | 7/1986 | Japan | 420/530 |

*Primary Examiner*—John Sheehan
*Attorney, Agent, or Firm*—Alan M. Biddison

[57] ABSTRACT

Free-machining aluminum alloys are disclosed containing effective amounts of tin and indium. The tin and indium additions are especially adapted for use as free-machining constituents in aluminum alloys, such as AA2000 and AA6000 series aluminum alloys. The additions can be used in place of bismuth and lead in currently available free machining alloys. In alloys containing bismuth and tin, the indium can be used to replace the bismuth. A method of producing a free-machining aluminum alloy product also is described.

16 Claims, No Drawings

MACHINEABLE ALUMINUM ALLOYS CONTAINING IN AND SN AND PROCESS FOR PRODUCING THE SAME

FIELD OF THE INVENTION

The present invention is directed to free-machining aluminum alloys containing tin and indium and a process for producing such alloys.

BACKGROUND ART

Free-machining aluminum alloys are well known in the art. These alloys typically include free-machining phases formed from elements such as lead, tin and bismuth for improved machinability. These elements form low melting point constituents which readily melt or are rendered weak due to the frictional heat created during machining. Thus, chip formation during material removal required for the manufacture of complex parts and components is easily facilitated.

These types of alloys generate small chips during the machining process which are easily collected and have minimal adverse impact on the machining process. It is essential that these free-machining aluminum alloys form these small chips for proper machining. Formation of long continuous strips or ribbons is totally unacceptable in machining since the ribbons or strips may wrap around the work piece or machining tool and disrupt the operation. Poor machinability also affects other machining operations since the operator must attend to a single machining operation and cannot effectively supervise numerous operations as is commonly done in practice. AA6061 alloys are generally not optimum for machining since they form these long continuous ribbons during machining.

U.S. Pat. Nos. 2,026,457 and 2,026,575 to Kempf et al. disclose free cutting aluminum alloys. Similarly, U.S. Pat. No. 4,005,243 to Baba et al. discloses a freely machinable aluminum alloy.

Other known machineable alloys include AA6262, AA2011, AA2012 and AA2111.

While the prior art aluminum alloys provide adequate free-machinability, they are not without drawbacks and/or disadvantages. For example, AA6262 contains lead and chips from machining these alloys represent a hazardous waste disposal problem. Casting and production of these alloys presents similar problems.

Prior art alloys containing bismuth, e.g., AA2011 or AA2111, can adversely effect the final mechanical properties of the machined part. Since bismuth has an affinity for magnesium, the bismuth in the alloy has a tendency to combine with the magnesium and prevent or reduce $Mg_2Si$ formation, which has the potential for reducing precipitation strengthening in AA6000-series alloys.

As such, a need has developed to provide a more environmentally friendly free-machining alloy as well as an alloy that does not have its final mechanical properties compromised by free-machining constituents therein. In response to this need, a free-machining aluminum alloy has been developed which contains indium and tin. The invention further provides a process for making such an alloy.

SUMMARY OF THE INVENTION

It is a first object of the present invention to provide a free-machining aluminum alloy which eliminates lead and its adverse effects on the environment.

Another object of the present invention is to provide a free-machining aluminum alloy containing indium and tin which has at least comparable free-machining properties as prior art alloys.

Another object of the present invention is to eliminate bismuth as a free-machining constituent in these types of alloys due to its probable adverse effect on precipitation hardening mechanisms.

Still another object of the present invention is to provide a process for producing enhanced free-machining aluminum alloys.

Other objects and advantages of the present invention will become apparent as a description thereof proceeds.

In satisfaction of the foregoing objects and advantages, the present invention provides an improvement over prior art free-machining alloys containing low melting point constituents. According to the invention, an effective amount of tin and indium is utilized in these types of alloys as free-machining constituents. The amount of tin and indium required to have an "effective" amount is expected to be a function of the machining parameters used with the alloy. An amount of 0.04 wt. % tin and an amount of 0.04 wt. % indium might constitute an effective amount with a relatively narrow window of machining parameters. With a wider window of machining parameters, an effective amount of tin might be greater than 0.05 wt. %, greater than 0.10 wt. %, or even higher. Similarly, an effective amount of indium might be greater than 0.05 wt. %, greater than 0.10 wt. %, or even higher. Further, an effective amount of tin and indium might be as low as 0.01 wt. %.

The effective amounts of tin and indium can be added to aluminum alloy chemistries, such as those typical of free-machining aluminum alloys such as AA6000 and AA2000 series alloys, as well as those of other alloy families.

The tin and indium can be added to the molten aluminum used to produce the alloy products in the form of master alloys, as scrap containing tin and indium, or as a combination of scrap and master alloys. The method of adding tin and indium is not critical to the invention.

More preferably, the tin and indium are added as substitutes for the free-machining constituents in AA6262 and AA2111 free-machining aluminum alloys. The tin and indium amounts can range from between an amount greater than zero, e.g. 0.01% and 1.5 wt. %. More preferably, the indium to tin ratio is maintained as an eutectic ratio or a tin-rich ratio. A hypereutectic ratio of tin to indium is preferred since it reduces the more expensive alloying constituent indium to reduce the overall cost of the alloy.

Preferably, the present invention discloses a free-machining aluminum alloy wherein the tin ranges between 0.05 and 0.8% and the indium ranges between 0.05 and 0.8% by weight.

BRIEF DESCRIPTION OF THE PREFERRED EMBODIMENTS

The present invention is an improvement over prior art free-machining aluminum alloys and the process used to produce such alloys. In prior art alloys containing lead, the lead presents a hazardous waste disposal problem for the machining chips. Other alloys such as AA2111 which contain bismuth can be adversely affected because of the bismuth inhibiting $Mg_2Si$ formation.

According to the invention, an effective amount of tin and indium can be substituted in these types of free-machining aluminum alloys without a loss in machinability. Tin and indium are principally substituted for the free-machining or low melting point constituents in the prior art alloys such as lead and bismuth.

An effective amount of tin and indium is a respective amount for each alloying component that when combined with each other and other alloying constituents, results in a free-machining aluminum alloy that generates the proper size machine chips for effective machining operation.

A broad range in weight percent for these alloying component is 0.01 to 1.5 weight percent for each of tin and indium for the entire aluminum alloy. Most preferably, the tin and indium ranges are each between 0.05 and 0.8 wt. %.

The ratio of indium to tin in the inventive free-machining aluminum alloy can be maintained at a eutectic ratio. The eutectic ratio for tin and indium is 52% indium to 48% tin. Preferably, in view of the high cost of indium, the ratio is maintained in a hypereutectic range, i.e., more tin than indium. While the eutectic ratio of indium to tin is 52:48 (1.083 indium: 1.0 tin), the ratio can vary between the weight percent limits identified above.

As stated above, the effective amount of tin and indium can be utilized in any type of aluminum alloy adaptable for free-machining. For example, AA2000 series, AA6000 or AA7000 series alloys may be utilized as part of the inventive free-machining aluminum alloy. With reference to Table I, weight percentage ranges for three prior art alloys are shown. These alloys are particularly adaptable to the invention. As is clear from Table I, AA6061 differs from AA6262 by the addition of bismuth and lead. AA2111 differs from AA6262 with respect to the free-machining constituents in that AA2111 uses bismuth and tin. According to the invention, the effective amounts of tin and indium can be merely added to an AA6061 alloy or substituted for the bismuth and lead in AA6262 or bismuth and tin in AA2111.

TABLE I

Prior Art Alloy Ranges

| Sample | Weight Percent* AA6061 | AA6262 | AA2111 |
|---|---|---|---|
| Si | .4–.8 | .4–.8 | .40 |
| Fe | .7 | .7 | .7 |
| Cu | .15–.40 | .15–.40 | 5.0–6.0 |
| Mn | .15 | .15 | — |
| Mg | .8–1.2 | .8–1.2 | — |
| Cr | .04–.35 | .04–.14 | — |
| Ni | — | — | — |
| Zn | .25 | .25 | .30 |
| Ti | .15 | .15 | — |
| Bi | — | .40–.70 | .20–.80 |
| Pb | — | .40–.70 | — |
| Sn | — | — | .10–.50 |
| In | — | — | — |
| others/each | .05 | .05 | .05 |
| others/total | .15 | .15 | .15 |
| Al | bal. | bal. | bal. |

*Percents are in maximums unless otherwise shown.

As will be more clearly demonstrated below, the use of effective amounts of tin and indium overcomes the drawbacks identified above with regard to these prior art alloys while maintaining and possibly improving machinability.

Table II depicts an alloy composition designated as INV A which corresponds to one embodiment of the invention.

TABLE II

Inventive Free-Machining Alloy Component Ranges

| Alloy | Weight Percent* INV A |
|---|---|
| Si | 0.4–0.8 |
| Fe | 0.7 max. |
| Cu | 0.15–0.40 |
| Mn | 0.15 max. |
| Mg | 0.8–1.2 |
| Cr | 0.04–0.20 |
| Zn | 0.25 max. |
| Ti | 0.10 max. |
| Sn | 0.05–1.0 |
| In | 0.05–1.0 |
| Others/Each | 0.05 max. |
| Others/Total | 0.15 max. |
| Al | bal |

Table IIIA discloses additional preferred embodiments of the invention, designated as INV B, INV C and INV D. INV B and INV C correspond generally to an AA6061 alloy, with a eutectic ratio of indium to tin added. INV D is similar to the component ranges of INV B and INV C except that the indium to tin ratio is tin-rich, i.e., 0.52 wt. % tin and 0.22 wt. % indium.

TABLE IIIA

Machinability Study Inventive Alloys

| Alloy Designation | Weight Percent INV B | INV C | INV D |
|---|---|---|---|
| Si | .61 | .63 | .63 |
| Fe | .30 | .30 | .30 |
| Cu | .21 | .21 | .21 |
| Mn | <.01 | <.01 | <.01 |
| Mg | .91 | .90 | .89 |
| Cr | .06 | .06 | .06 |
| Ni | <.01 | <.01 | <.01 |
| Zn | .02 | .02 | .02 |
| Ti | .02 | .02 | .02 |
| Bi | — | — | — |
| Pb | — | — | — |
| Sn | .36 | .20 | .52 |
| In | .38 | .22 | .22 |

To demonstrate the equivalent or better machinability of the inventive alloys, the alloy compositions identified in Table IIIA were used in a machinability study. For comparison purposes, the specific alloys shown in Table IIIB were used, which are representative of commercially available alloys. COMP A and COMP C correspond to AA6262 and COMP B corresponds to AA6061.

TABLE IIIB

Machinability Study Prior Art Alloy Component Ranges

| Alloy Designation | Weight Percent COMP A | COMP B | COMP C |
|---|---|---|---|
| Si | .60 | .62 | .62 |
| Fe | .25 | .30 | .31 |
| Cu | .35 | .21 | .21 |
| Mn | <.01 | <.01 | <.01 |
| Mg | 1.15 | .88 | 1.04 |
| Cr | .10 | .05 | .04 |

TABLE IIIB-continued

| Machinability Study Prior Art Alloy Component Ranges | | | |
|---|---|---|---|
| | Weight Percent | | |
| Alloy Designation | COMP A | COMP B | COMP C |
| Ni | <.01 | <.01 | <.01 |
| Zr | .02 | .02 | .02 |
| Ti | .03 | .02 | .02 |
| Bi | .52 | — | .55 |
| Pb | .59 | — | .60 |
| Sn | — | — | — |
| In | — | — | — |
| Al | bal. | bal. | bal. |

The compositions of Table IIIA and Table IIIB were processed conventionally to provide products for the machinability study. Specifically, alloy compositions were provided in a furnace containing molten aluminum. The molten aluminum was direct chill cast to provide ingots or billets which were homogenized and scalped. The billets were worked or hot extruded and quenched to provide products (T1). The products were either solution heat treated, water quenched and aged (T6) or were aged directly after the extrusion and quenching process (T5). It should be readily appreciated that other processes well known to those skilled in the art could have been used to provide the products, such as rolling the ingots to provide sheet or plate and conventionally processed.

The machinability study was a turning operation conducted under severe machining conditions to show that the inventive free-machining aluminum alloys favorably compare with the prior art alloys even under the most adverse machining conditions.

For the machining study, new inserts were used for each test without lubrication. The other machining conditions were as follows:

RPM - 2000; inches fed per revolution - 0.005;

initial diameter≈0.975";

final diameter approximately 0.874";

cut length 6";

fixed rake angle;

standard tool without chip breaker.

To further substantiate the adaptability of the inventive free-machining aluminum alloys, various tempers were utilized in the machinability study. Since these temper designations are well known in the art, a detailed description thereof is not deemed necessary for understanding of the invention. The reproducability of the results of the machinability study at various tempers further substantiates the free-machining properties of the alloys according to the invention.

Table IV relates the various alloys used in the machinability study and their respective tempers with two variables. First, chips/gram are shown for the various alloys as a measure of machinability. It is desirable to have a relatively high number for this variable to indicate that small sized chips are formed during machining. Table IV also uses chip shape as a machinability variable. During the machinability study, the machine chips were classified according to their size and shape for comparison purposes.

TABLE IV

| Machinability Study | | | |
|---|---|---|---|
| Alloy | Temper | Chips/gm | Chip Shape |
| | | Prior Art Alloys | |
| 2011 | T3[c] | 78–120 | Very Small Curly Chips |
| 6262 | T1[a] | <1 | Long curly String |
| | T5[b] | 44 | Medium Chips |
| | T6511[c] | <1 | Long Curly String |
| | T9[c] | <1 | Long Curly String |
| COMP B (6061) | All Tempers | <1 | Long Strings |
| | | Inventive Alloys | |
| INV B | T1 | 56 | Medium Chips |
| | T5 | 86 | Small Chips |
| | T6 | 74 | Small Chips |
| INV C | T1 | 48 | Medium Chips |
| | T5 | 54 | Small Chips |
| | T6 | 31 | Medium Chips |
| INV D | T1 | 24 | Medium Chips |
| | T5 | 85 | Small Chips |
| | T6 | 36 | Medium Chips |

[a]COMP A
[b]COMP C
[c]Commercial production

The results depicted in Table IV clearly demonstrate that the inventive alloys used in the machinability study provide at least comparable free-machining characteristics as obtained with the prior art alloys. The chip sizes for each of the inventive alloys, INV B, INV C and INV D range from small to medium chips. This compares favorably to the free-machining AA2011 prior art alloy which develops very small chips during machining. Under very severe test conditions, commercially available AA6262 with T6511 and T9 treatments have produced long curly strings, whereas the inventive alloys produced small to medium sized discrete chips. Only once, under less severe conditions, did alloy AA6262-T6511 produce small size chips.

The chips per gram value is also comparable between the prior art alloys and the inventive alloys. This further substantiates the comparable machinability of the invention as compared to known free-machining alloys.

It should be noted that alloy INV D has a tin-rich ratio of tin to indium, see Table IIIA, but still provides acceptable machinability, i.e., medium curls/chips for T1 and T6 tempers and 85 chips per gram for a T5 temper. This is especially significant since indium is quite expensive and it is more desirable to maximize the amount of tin in the free-machining alloy to reduce cost. From this, it is clear that the effective amounts of tin and indium for the inventive alloy are not solely limited to eutectic ratios of indium to tin.

In conjunction with the machinability study, the metallurgical aspects of the alloys according to the invention were also compared to the prior art alloys. With reference to Table V, a comparison is shown between the inventive alloys and the prior art in terms of volume percent of low melting (LM) phase and melting point (melting ranges for INV D) of the free-machining constituents.

TABLE V

Comparison of Melting Point and Volume Percent of (LM) Phase

| Alloy/ Temper | 2011-T3 | 6061/ COMP B | 6262 | INV B* | INV C* | INV D* |
|---|---|---|---|---|---|---|
| Melting Point °C. | 125.5 | — | 125.5 | 120° | 120° | 120–175° |
| Vol. % LM Phase | >.50 | — | >.50 | >.50 | .30 | .50 |

The volume percent LM phase identified in Table V provides an indication of machinability for these types of alloys. As is evident from Table V, the volume percent LM phase for INV B and INV D is equivalent to the prior art alloys. Further, based upon the machinability study results of Table IV, a volume percent LM phase of 0.30%, i.e., INV C, is also acceptable from a machinability standpoint. This LM phase percentage corresponds to 0.20 wt. % tin and 0.22 wt. % indium. It is believed that machinability can be achieved even at 0.1 volume percent low melting phase, which is equivalent to 0.07 wt. % tin and 0.07 wt. % indium.

Referring to Table V again, the melting points and ranges of the inventive alloys show correspondence with the prior art alloys. In fact, INV D with its higher percentage of tin shows a melting range exceeding the prior art melting point values. However, INV D still shows acceptable machinability properties as evidenced by the machinability study results of Table IV.

The inventive free-machining aluminum alloy can be easily manufactured by adding the effective amounts of tin and indium to known alloy compositions. For example, an AA6061 alloy can be modified by the addition of tin and indium to the furnace containing the molten metal to within the ranges described above. Alternatively, the tin and indium can be substituted in the furnace for the free-machining constituents of lead and bismuth, when present in AA1XXX, AA2XXX, AA3XXX, AA5XXX, AA6XXX, or AA7XXX series alloys, or added to the melt when lead and bismuth are not present.

As such, an invention has been described in terms of preferred embodiments thereof which fulfills each and every one of the objects of the present invention as set forth hereinabove and provides a new and improved free-machining aluminum alloy containing tin and indium in effective amounts.

Following are some representative embodiments of alloys according to the present invention:

ALLOY X 0.4 to 0.8 wt. % silicon;

up to 0.7 wt. % iron;

between 0.15 and 0.40 wt. % copper;

up to 0.15 wt. % manganese;

between 0.8 and 1.2 wt. % magnesium;

between 0.04 and 0.35 wt. % chromium;

up to 0.25 wt. % zinc;

up to 0.15 wt. % titanium;

between 0.04 and 1.5 wt. % tin, or between 0.05 and 1.5 wt. % tin;

between 0.04 and 1.5 wt. % indium, or between 0.04 and 1.5 wt. % indium;

with the balance aluminum and inevitable impurities.

ALLOY Y up to 0.40 wt. % silicon;

up to 0.70 wt. % iron;

between 4.0 and 6.0 wt. % copper;

up to 0.30 wt. % zinc;

up to 0.15 wt. % titanium;

between 0.04 and 1.5 wt. % tin, or between 0.04 and 1.5 wt. % tin;

between 0.04 and 1.5 wt. % indium, or between 0.04 and 1.5 wt. % indium;

with the balance aluminum and inevitable impurities.

ALLOY Z 0.6 to 1.0 wt. % silicon;

up to 0.5 wt. % iron;

between 0.3 and 1.1 wt. % copper;

between 0.2 to 0.8 wt. % manganese;

between 0.6 and 1.2 wt. % magnesium;

up to 0.15 wt. % chromium;

up to 0.25 wt. % zinc;

up to 0.15 wt. % titanium;

between 0.04 and 1.5 wt. % tin, or between 0.04 and 1.5 wt. % tin;

between 0.04 and 1.5 wt. % indium, or between 0.04 and 1.5 wt. % indium;

with the balance aluminum and inevitable impurities.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A lead-free free-machining aluminum alloy comprising an aluminum alloy including an effective amount of tin and an effective amount of indium, the effective amounts of tin and indium being those amounts of tin and indium that when combined with each other and with other elements in the alloy form low melting point constituents that melt during a machining operation to facilitate formation of proper size machine chips for effective machining, the amount of tin in the alloy ranging from 0.04 to 1.5 wt. %, the amount of indium being greater than 0.10 wt. %, and the alloy having copper as a major alloying element.

2. The free-machining alloy of claim 1 wherein said tin and indium further comprise an eutectic ratio of tin to indium.

3. The free-machining alloy of claim 1 wherein said tin and indium further comprise a tin-rich ratio of tin to indium.

4. The free-machining alloy of claim 1 wherein said tin and indium range from 0.05 to 0.8 wt. %.

5. The free-machining alloy of claim 4 wherein said indium ranges between 0.22 and 0.38 wt. % and said tin ranges between 0.20 and 0.52 wt. %.

6. A lead free free-machining aluminum alloy consisting essentially in weight percent of:

between 0.4 and 0.8% silicon;

up to 0.7% iron;

between 0.15 and 0.40% copper;

up to 0.15% manganese;

between 0.8 and 1.2 wt. % magnesium;

between 0.04 and 0.20% chromium;

up to 0.25% zinc;

up to 0.10% titanium;

between 0.05 and 1.0% indium; and between 0.05 and 1.0% tin;

with the balance aluminum and inevitable impurities, the amounts of tin and indium being controlled so that when the tin and indium combine with each other and with other elements in the alloy low melting point constituents are formed that melt during a machining operation to provide proper size machine chips for effective machining.

7. A lead-free free-machining aluminum alloy comprising an aluminum alloy including an effective amount of tin and an effective amount of indium, the effective amounts of tin and indium being those amounts of tin and indium that when combined with each other and with other elements in the alloy form low melting point constituents that melt during a machining operation to facilitate formation of proper size machine chips for effective machining, the amount of tin in the alloy ranging from 0.04 to 1.5 wt. %, the amount of indium being greater than 0.10 wt. %, and the alloy having magnesium and silicon as major alloying elements.

8. A lead free free-machining aluminum alloy comprising an aluminum alloy including an effective amount of tin and an effective amount of indium, the effective amounts of tin and indium being those amounts of tin and indium that when combined with each other and with other elements in the alloy form low melting point constituents that melt during a machining operation to facilitate formation of proper size machine chips for effective machining said aluminum alloy consisting essentially in weight percent of:

between 0.4 and 0.8% silicon;

up to 0.7% iron;

between 0.15 and 0.40% copper;

up to 0.15% manganese;

between 0.8 and 1.2 wt. % magnesium;

between 0.04 and 0.35% chromium;

up to 0.25% zinc;

up to 0.15% titanium;

between 0.05 and 1.5% indium; and between 0.05 and 1.5% tin;

with the balance aluminum and inevitable impurities.

9. The free-machining alloy of claim 8, wherein said alloy has greater than 0.10 wt. % indium.

10. The free-machining alloy of claim 8 wherein said tin and indium are in a eutectic ratio.

11. The free-machining alloy of claim 10 wherein said tin and indium each range from 0.05 to 0.8 wt. %.

12. The free-machining alloy of claim 8 wherein said indium ranges between 0.22 and 0.38 wt. % and said tin ranges between 0.20 and 0.52 wt. %.

13. A lead free free-machining aluminum alloy comprising an aluminum alloy including an effective amount of tin and an effective amount of indium, the effective amounts of tin and indium being those amounts of tin and indium that when combined with each other and with other elements in the alloy form low melting point constituents that melt during a machining operation to facilitate formation of proper size machine chips for effective machining said alloy in weight percent consisting essentially of:

between 0.05 and 1.5% indium;

between 0.05 and 1.5% tin;

up to 0.40 wt. % silicon;

up to 0.70 wt. % iron;

between 4.0 and 6.0 wt. % copper;

up to 0.30 wt. % zinc;

up to 0.15 wt. % titanium;

with the balance aluminum and inevitable impurities.

14. The free-machining alloy of claim 13, wherein said alloy has greater than 0.10 wt. % indium.

15. The free-machining alloy of claim 13 wherein said tin and indium each range from 0.05 to 0.8% wt. %.

16. The free-machining alloy of claim 15 wherein said indium ranges between 0.22 and 0.38 wt. % and said tin ranges between 0.20 and 0.52 wt. %.

* * * * *